US005526937A

United States Patent [19]

Rossmanith

[11] Patent Number: 5,526,937

[45] Date of Patent: Jun. 18, 1996

[54] PROCESS FOR REGENERATING USED FOUNDRY SAND HAVING HIGH OOLITIC LEVELS

[75] Inventor: Peter Rossmanith, Rielasingen, Germany

[73] Assignee: Georg Fischer Giessereianlagen AG, Schaffhausen, Switzerland

[21] Appl. No.: 347,518

[22] Filed: Nov. 30, 1994

[30] Foreign Application Priority Data

Dec. 10, 1993 [SE] Sweden ..... 03690/93

[51] Int. Cl.[6] ..... B07B 15/00; B02C 19/12

[52] U.S. Cl. ..... 209/11; 209/214; 241/24.14; 241/DIG. 10; 164/5

[58] Field of Search ..... 209/10, 11, 214, 209/215, 12.1; 241/14, 23, 24, DIG. 10; 164/5

[56] References Cited

U.S. PATENT DOCUMENTS

| | | | |
|---|---|---|---|
| 3,312,403 | 4/1967 | Zifferer | 241/24 |
| 3,764,078 | 10/1973 | Richard | 241/DIG. 10 X |
| 4,491,277 | 1/1985 | Bauer et al. | 241/DIG. 10 X |
| 4,671,867 | 6/1987 | Battie et al. | 209/214 X |
| 4,700,766 | 10/1987 | Godderidge | 164/5 |
| 5,279,741 | 1/1994 | Schott | 241/DIG. 10 X |

FOREIGN PATENT DOCUMENTS

| | | | |
|---|---|---|---|
| 238341 | 8/1986 | Germany | 241/DIG. 10 |
| 3642916 | 6/1988 | Germany . | |
| 56-86646 | 7/1981 | Japan | 241/DIG. 10 |

*Primary Examiner*—William E. Terrell
*Assistant Examiner*—Tuan Nguyen
*Attorney, Agent, or Firm*—Bachman & LaPointe

[57] ABSTRACT

A process for regenerating used foundry sand having high oolitic level and, more particularly, a process as aforesaid wherein the used foundry sand is subjected to magnetic separation by one or more high power magnets for dividing the used foundry sand into a first highly magnetic stream containing a high degree of oolite particles and a second less magnetic stream having a relatively high degree of sand particles.

8 Claims, 1 Drawing Sheet

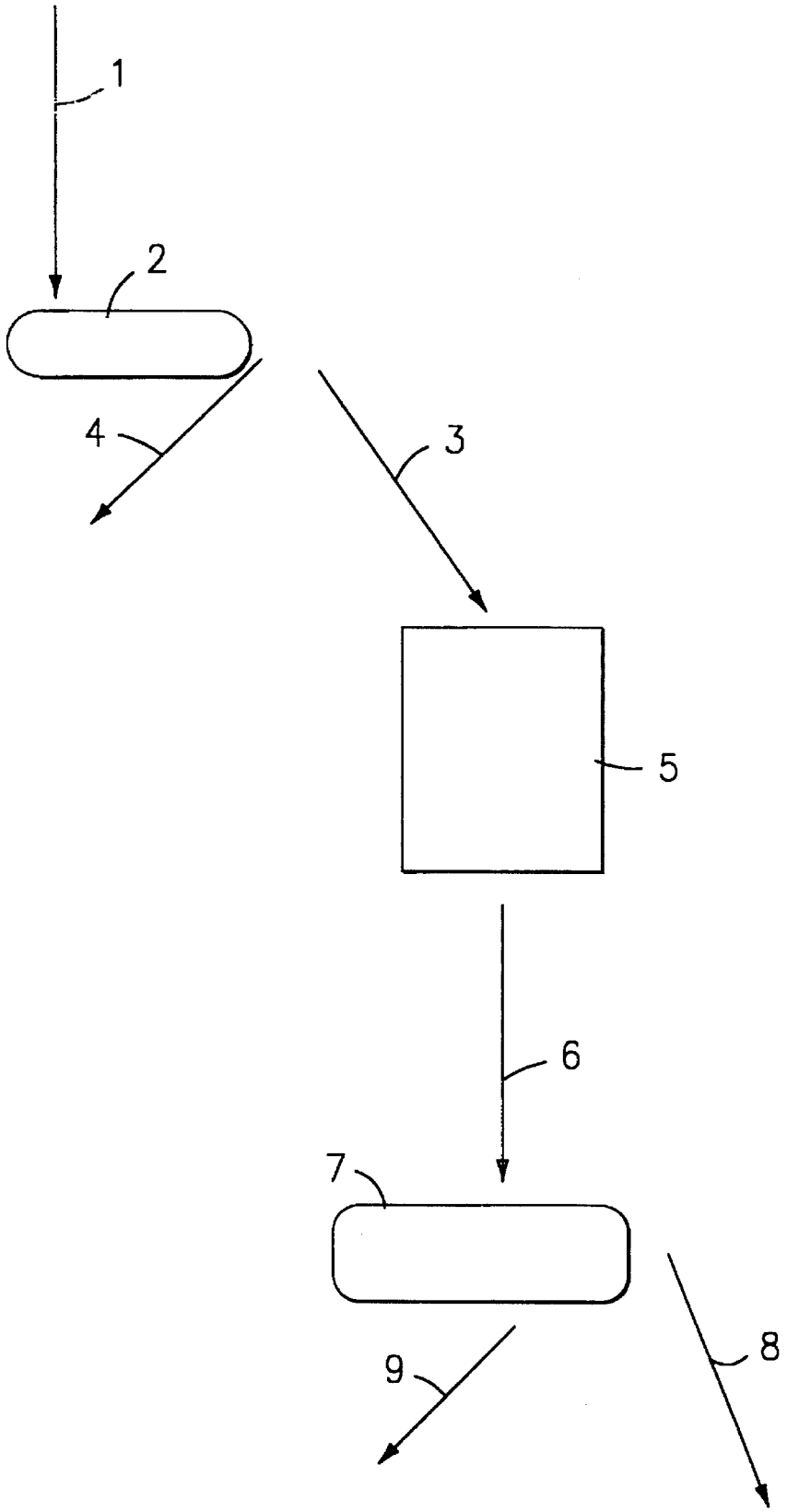
1
2
4
3
5
6
7
9
8

PROCESS FOR REGENERATING USED FOUNDRY SAND HAVING HIGH OOLITIC LEVELS

BACKGROUND OF THE INVENTION

The present invention is drawn to a process for regenerating used foundry sand having high oolitic levels and, more particularly, a process as aforesaid wherein the used foundry sand is subjected to magnetic separation by one or more high power magnets for dividing the used foundry sand into a first highly magnetic stream containing a high degree of oolite particles and a second less magnetic stream having a relatively high degree of sand particles.

It is known in the prior art to reclaim used foundry sand to mechanical and/or thermal treatment followed by a separating process which separates the sand granules from the oolith materials. Typical prior art processes are disclosed for example in U.S. Pat. No. 3,312,403 and U.S. Pat. No. 5,163,562. In addition to the known processes disclosed above, German Document DE 36 42 916 discloses a process for reclaiming used foundry sand wherein the foundry sand is subjected sequentially to the steps of screening, annealing, pressure blasting and magnetic separation. The aforesaid process disclosed in the German document is very expensive. In particular, because of the annealing step in the German process, a very high energy is required which adds considerably to the expense of the process.

In order to overcome the problems associated with known sand recovery processes, it is the object of the present invention to provide a process which allows for the separation of new sand particles which are easily regenerable from those particles which are difficult to regenerate prior to performing the actual mechanical and or thermal regeneration steps.

SUMMARY OF THE INVENTION

The foregoing object is achieved by way of the present invention wherein used foundry sand is separated by magnetic means into two magnetic streams, a first highly magnetic stream containing a high degree of oolite particles which stream is difficult to generate and a second less magnetic stream having a relatively high degree of sand particles and small amount of bentonite when compared to the first magnetic stream, the second stream being relatively easy to regenerate. In accordance with the present invention, the separation takes place by using at least one high powered magnet for separating the used foundry sand into the two streams as discussed above. Once separated into two streams, the second less magnetic stream having a relatively high degree of sand particles and small amounts of bentonite can be regenerated by known processes in a relatively easy and inexpensive manner.

BRIEF DESCRIPTION OF THE DRAWING

The FIGURE is a schematic illustration of the process in accordance with the present invention.

DETAILED DESCRIPTION

The process of the present invention will be described hereinbelow with reference to the FIGURE.

The basis of the present invention is based on the natural phenomenon that bentonites, which exist in nature with an $Fe_2O_3$ content, have magnetic properties. The invention is further based on the fact that the higher the amount of bentonite, the higher the degree of oolitic levels, and/or the higher the amount of dead-burned bentonite in the used sand, the more expensive the mechanical or thermal treatment is for regenerating the used sand. In the case of a typical used sand having a level of oolitic particles of around 12% the regeneration time amounts to 30 to 35 minutes and the yield of residual material amounts to 30 to 40% of the total material treated.

In accordance with the present invention, by employing a high power magnet, preferably a permanent magnet, the used foundry sand can be separated into two types of sand streams, one sand stream being relatively high in sand particles and free of bentonite and oolitic particles and the second stream having a high degree of oolitic particles. The process of the present invention is particularly suitable when the used foundry sand contains less than 65% molding sand as the efficiency of the separation process is superior at such molding sand levels.

With reference to the FIGURE, a used foundry sand stream is delivered via line 1 to a high power magnetic separator 2 for separating the molding sand into a substantially non-magnetic fraction 3 and a highly magnetic fraction 4. In order to achieve a high degree of separation by the magnetic separator 2 the sand is fed to and from the separator at a rate of between about 0.2 to 1.0 meter per second. The highly magnetic fraction or stream 4 contains a high degree of oolitic particles while the substantially non-magnetic or less magnetic stream 3 has a relatively high degree of sand particles and a small amount of bentonite when compared to stream 4.

As the substantially non-magnetic stream 3 still contains small trace amounts of molding sand with bentonite, the stream cannot be reused directly as core sand. Accordingly, the substantially non-magnetic stream 3 is delivered to regeneration plant 5 for mechanical and or thermal regeneration as known in the art. The actual time required for regenerating the substantially non-magnetic stream 3 in the regeneration unit 5 is substantially less, normally one half the amount of time, that would be required when processing the used sand without magnetic separation.

Accordingly, by providing an upstream magnetic separation prior to the regeneration treatment, a reduction in regenerating costs is realized. In addition, a further advantage is obtained when using thermal regeneration in the regeneration treatment 5. By separating out bentonite-containing sands prior to the thermal regeneration, the bentonite-containing sands are not sintered and thus do not lead to an increase in the pH of the regenerated material. Tests have shown that sand separated by means of high powered magnets after a heat treatment produces 30% higher course strength mold than the regenerated materials without a preliminary separation stage in accordance with the present invention. In addition to the foregoing, the process of the present invention allows for so-called exothermic feeders to be removed out of the sand. These feeders as a rule contain binder such as sodium silicate which interfere with the reuse of the regenerated sand. By employing the process of the present invention, these exothermic feeders are separated out by the magnetic separation. The resulting sand particles may be recycled to a sand mold making unit (not shown).

With further reference to the FIGURE, the regenerated sand stream 6 from the regeneration plant 5 may be subject to further high powered magnetic separation in magnetic separator 7 for further removing powdered bentonite particles, exothermic feeders, and the like via line 8 from the magnetic fraction in line 9. In addition, micropellets in the form of very fine quartz particles mixed with binding clays and having grain sizes of smaller than 2 millimeters which result from mechanical abrasion in the regenerating process 5 may remain in the regenerated sand stream 6. These micro pellets likewise can be removed by the subsequent magnetic separation in magnetic separator 7.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A process for regenerating used foundry sand having high oolitic levels comprises:

(a) feeding used foundry sand having high oolitic levels to a magnetic separator;

(b) separating said used foundry sand with a magnetic separator into a first highly magnetic stream containing a high degree of oolitic particles and a second less substantially non-magnetic stream having a relatively high degree of sand particles and smaller amounts of bentonite when compared to the first highly magnetic stream;

(c) subjecting said second less magnetic stream to regeneration treatment for separating the bentonite from the sand particles to produce a regenerated sand stream; and (d) subjecting said regenerated sand stream to further magnetic separation in a second magnetic separator for further removal of powdered bentonite particles and exothermic feeders.

2. A process according to claim 1 wherein said regeneration treatment is mechanical regeneration.

3. A process according to claim 1 wherein said regeneration treatment is pneumatic regeneration.

4. A process according to claim 1 wherein said regeneration treatment is thermal regeneration.

5. A process according to claim 1 feeding the used foundry sand to and from the magnetic separator at a rate of between about 0.2 to 1.0 meter per second.

6. A process according to claim 1 wherein said first highly magnetic stream is less than or equal to 40% by weight of the used foundry sand.

7. A process according to claim 1 wherein the used foundry sand contains up to 65% by weight molding sand.

8. A process according to claim 7 wherein said first highly magnetic stream is less than or equal to 40% by weight of the used foundry sand.

* * * * *